US005740932A

United States Patent [19]

Battegazzore

[11] Patent Number: 5,740,932

[45] Date of Patent: Apr. 21, 1998

[54] SECURITY CLOSURE FOR BOTTLES AND THE LIKE

[75] Inventor: Piero Battegazzore, Alessandria, Italy

[73] Assignee: Guala Patents B.V., Amsterdam, Netherlands

[21] Appl. No.: 552,297

[22] Filed: Nov. 2, 1995

[51] Int. Cl.[6] ..... B65D 41/34

[52] U.S. Cl. ..... 215/252; 215/321; 215/334

[58] Field of Search ..... 215/43, 252, 258, 215/321, 334

[56] References Cited

U.S. PATENT DOCUMENTS

| | | | |
|---|---|---|---|
| 4,458,817 | 7/1984 | Guala | 215/252 X |
| 4,771,904 | 9/1988 | Perne et al. | 215/252 |
| 4,830,207 | 5/1989 | Battegazzore | 215/252 |
| 5,244,107 | 9/1993 | Battegazzore | 215/252 |
| 5,251,769 | 10/1993 | Battegazzore | 215/252 |

FOREIGN PATENT DOCUMENTS

| | | |
|---|---|---|
| 0 154 611 A3 | 9/1985 | European Pat. Off. . |
| 0 433 193 A1 | 6/1991 | European Pat. Off. . |
| 0 475 854 A1 | 3/1992 | European Pat. Off. . |
| 0 514 566 A1 | 11/1992 | European Pat. Off. . |
| 0 515 260 A1 | 11/1992 | European Pat. Off. . |
| 0 537 530 A1 | 4/1993 | European Pat. Off. . |

*Primary Examiner*—Stephen Cronin
*Attorney, Agent, or Firm*—Lowe, Price, LeBlanc & Becker

[57] ABSTRACT

A security closure for bottles and the like, which makes unauthorized opening clearly evident, comprises a pourer body, a cylindrical sleeve having an inner rim for retaining the pourer body, a cap screwed onto the pourer body, and a security band constituted by a ring which is divided into two structurally-independent, identical portions, and which is fixed to the cap by means of a weakened line, external teeth being formed on the cylindrical sleeve and opposing internal teeth being formed on the ring for engaging the teeth when the cap is first unscrewed.

9 Claims, 3 Drawing Sheets

SECURITY CLOSURE FOR BOTTLES AND THE LIKE

FIELD OF THE INVENTION

The present invention relates to a security closure for bottles and the like.

BACKGROUND OF THE INVENTION

A known security closure comprises a pourer body, a cylindrical sleeve having an internal rim for retaining the pourer body, a cap, a threaded coupling between the cap and the pourer body for the unscrewing and screwing of the cap, and a security band.

Although these known closures are advantageous from many points of view, they have a recognized disadvantage which, up to now, has not been overcome.

In fact, after a non-authorized opening of the bottle, a person can, with patience and dexterity, reassemble the security band so that it adopts practically the same starting position. This may mislead a subsequent purchaser who does not notice that the closure has been tampered with.

The problem upon which the present invention is based is that of devising a closure of the type specified which has structural and functional characteristics such as to overcome the disadvantage identified above.

SUMMARY OF THE INVENTION

This problem is solved by a security closure wherein the security band comprises a ring which is divided into at least two portions and is fixed to the cap by means of a weakened line, external teeth being formed on the cylindrical sleeve and opposing internal teeth being formed on the ring for engaging the teeth when the cap is first unscrewed.

BRIEF DESCRIPTION OF THE DRAWINGS

Further characteristics and advantages of the closure according to the invention will become clear from the following description of a preferred embodiment thereof which is given by way of non-limiting example with reference to the appended drawings, in which.

DETAILED DESCRIPTION OF THE INVENTION

Figure 1:
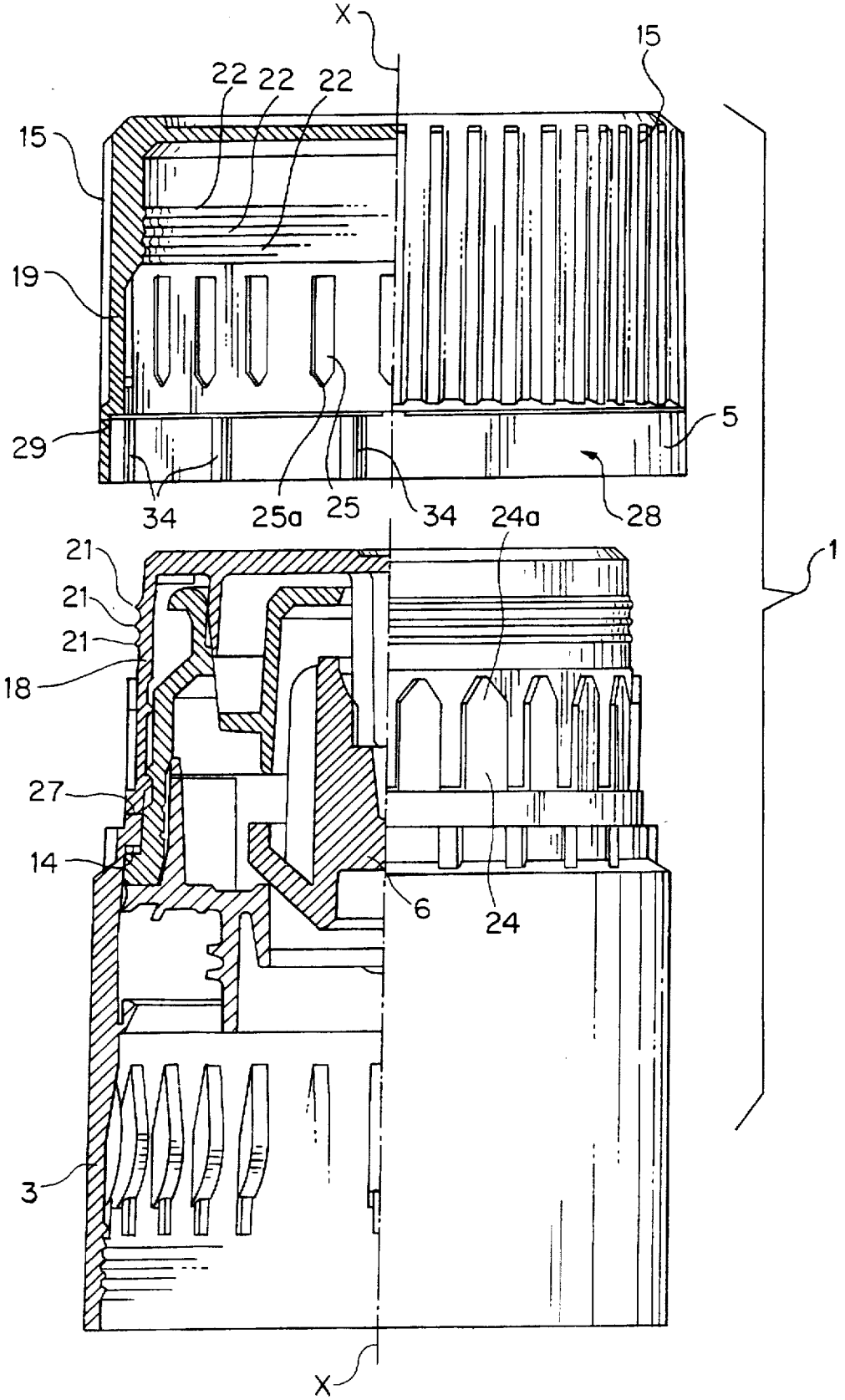
FIG. 1 is a partially-sectioned view of a closure according to the invention with parts removed.
Figure 2:
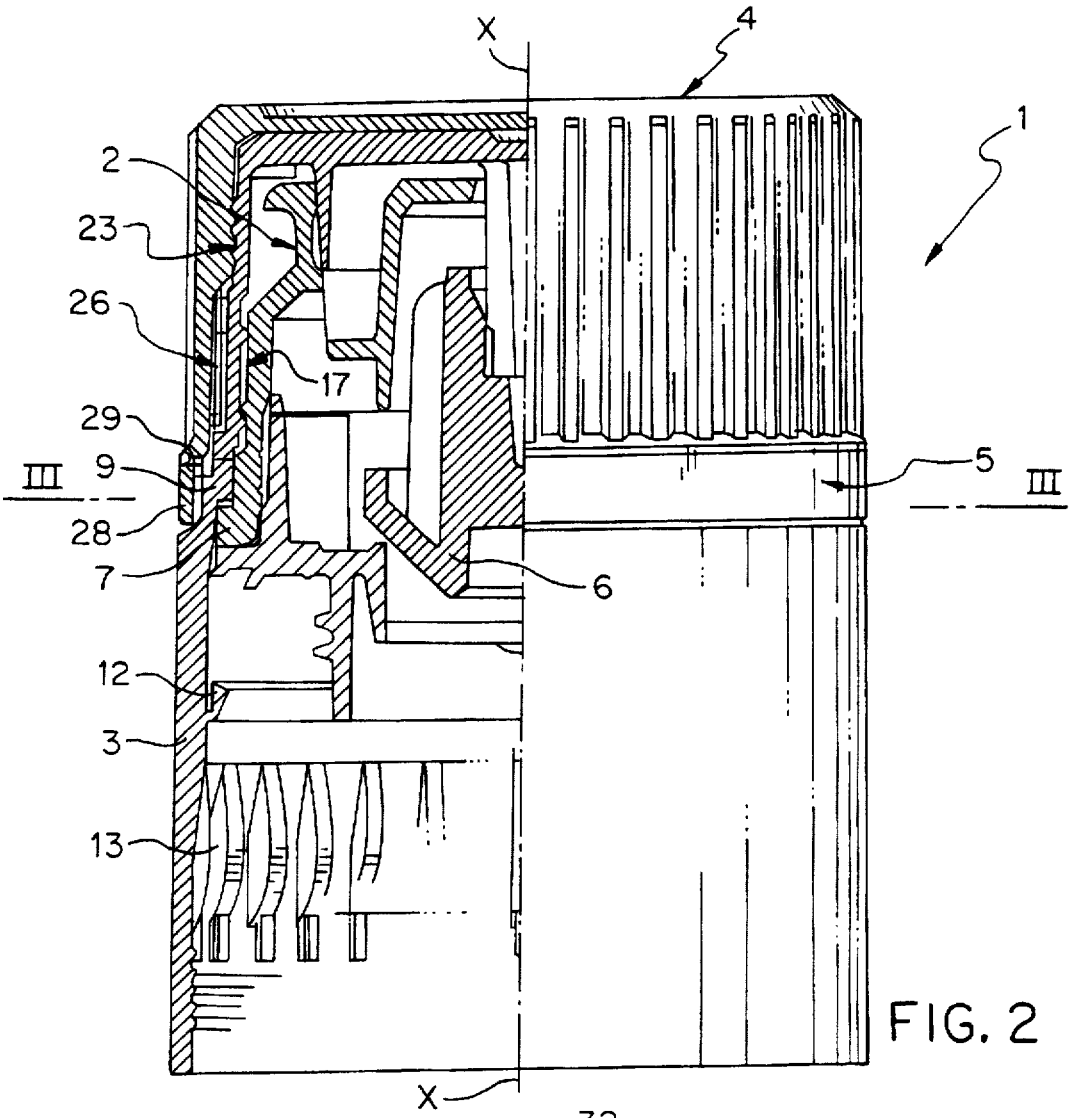
FIG. 2 is a section through the closure of FIG. 1, FIG. 3 a section through a detail of the closure of FIG. 2, taken on the line III—III.
Figure 3:
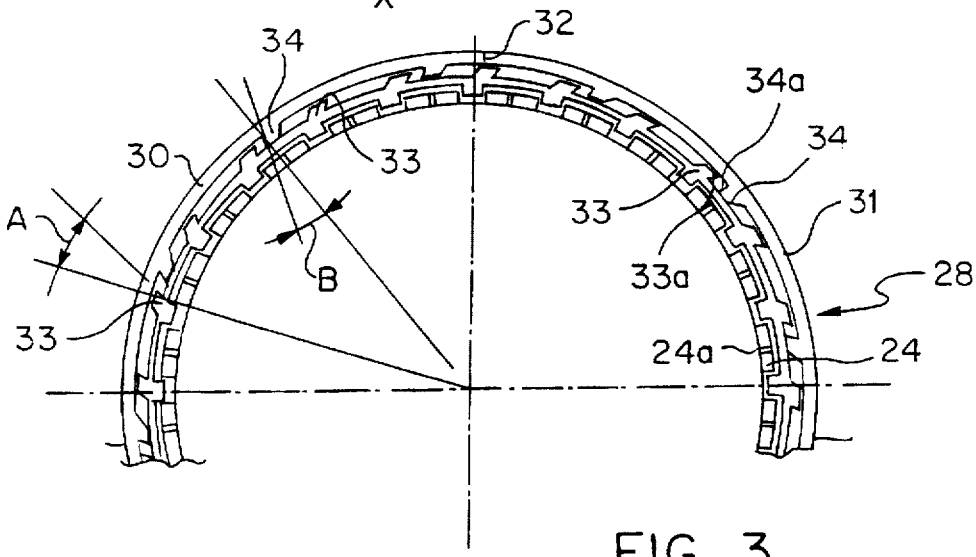
Figure 4:
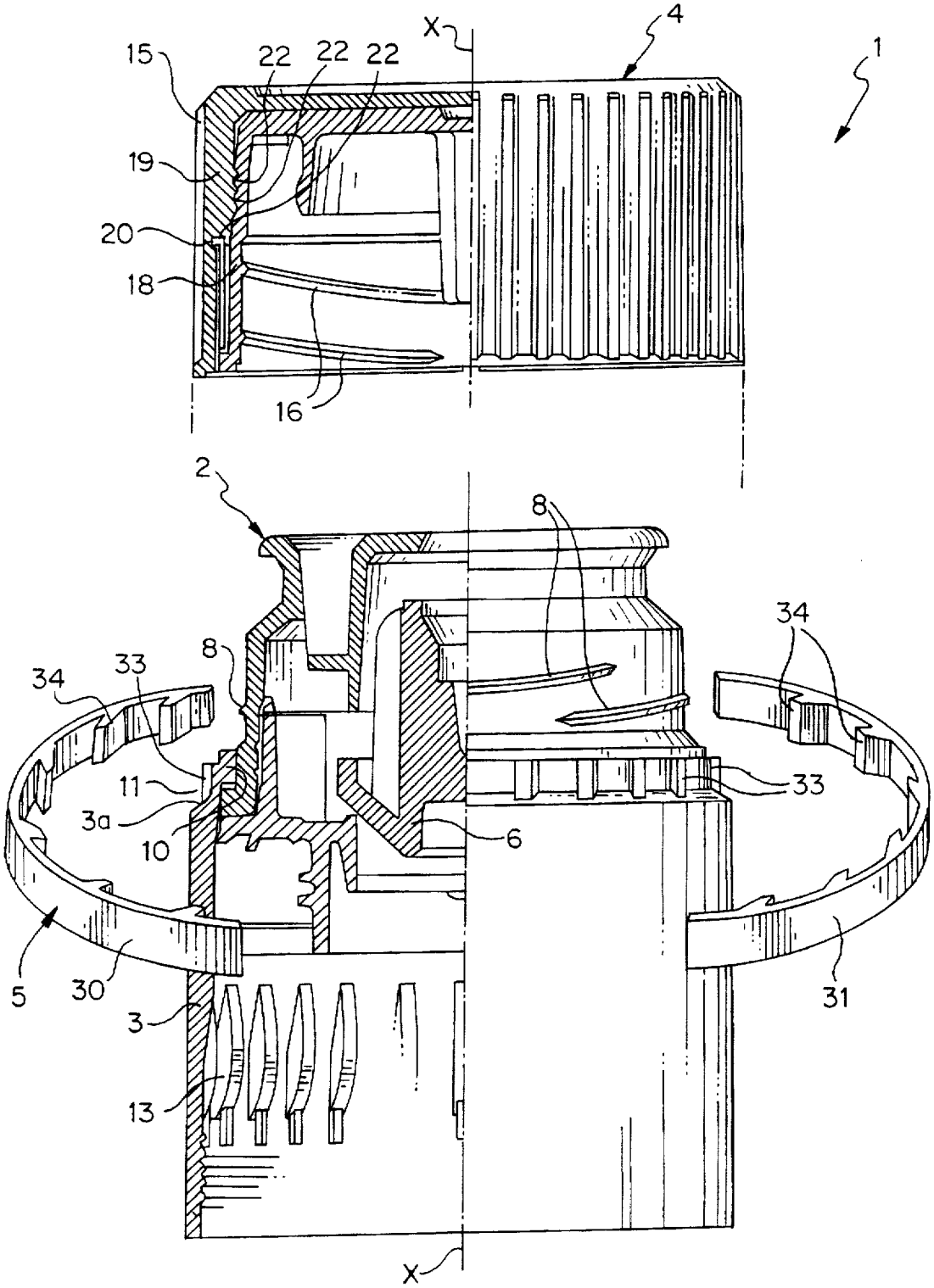
FIG. 4 is a view of the closure of FIG. 1 at another stage of its operation.

With reference to the appended drawings, a security closure, generally indicated 1, is intended for a bottle, not shown, particularly for good-quality liqueurs.

The closure 1 comprises a pourer body 2, a cylindrical sleeve 3, a cap 4 and a security band 5, which are joined together coaxially along an axis X—X.

The pourer body 2 comprises an internal obturator valve, generally indicated 6, for preventing refilling of the bottle and has an outer flange 7 and an external thread 8.

The cylindrical sleeve 3 comprises an upper end 9 on which there is an internal rim 10 which overlaps the flange 7, as well as an outer recess defined by a sloping shoulder 3*a*. The cylindrical sleeve 3 has an internal annular lip 12 and axial projections 13 which are intended to engage a groove and channels respectively provided in the bottle in order to fix the sleeve firmly to the bottle axially and with regard to rotation.

The sleeve 3 in turn holds the pourer body 2 on the bottle axially by the engagement of the rim 10 on the flange 7. A frontal coupling with teeth 14 is formed between the flange 7 and the rim 10 to fix the pourer body 2 with regard to rotation relative to the cylindrical sleeve 3, and thus to the bottle.

The cap 4 has external knurling 15 and an internal thread 16 which, with the external thread 8, constitutes a threaded coupling 17 for the screwing of the cap onto the pourer body and its unscrewing therefrom, according to need.

In particular, the cap 4 comprises an inner cap 18 and an outer cap 19 which is fitted onto the inner cap 18.

Connection means 20 are formed between the inner cap 18, which has the internal thread 16, and the outer cap 19, which has the outer knurling 15, in order to fix the inner cap and the outer cap together.

In particular, the connection means comprise external collars 21 on the inner cap and internal annular projections 22 on the outer cap, which are snap-engaged one above another to form a coupling 23 in order to fix the inner cap and the outer cap together axially.

In order to fix the inner cap and the outer cap with regard to rotation relative to one another, external axial splines 24 on the inner cap and internal axial splines 25 in the outer cap form a splined coupling 16.

The splines 24 and 25 are pointed with respective lead-in tips 4*a* and 25*a* for guiding the outer cap onto the inner cap in accordance with a predetermined angular pitch upon fitting.

It should be noted that the inner cap 18 is fixed to the cylindrical sleeve 3 by means of a weakened line 27, the weakened line being produced by the action of blades after the inner cap and the sleeve have been moulded as a single item.

The security band 5 is formed as a ring 28 which is fixed to the outer cap 18 by means of a weakened line 29.

The ring 28 is substantially housed in the recess 11 and is substantially in contact with the sloping shoulder 3*a*.

The ring 28 is divided into two structurally independent, identical, semicircular portions 30 and 31 by means of two diametrally-opposed cuts 32.

The weakened line 29 and the two cuts 32 are produced by the action of blades after the outer cap and the ring have been moulded as a single piece.

A plurality of external teeth 33, twenty-four teeth in the embodiment shown, is formed on the cylindrical sleeve 3 in the recess 11. A plurality of opposing teeth 34, twelve teeth in the embodiment shown, is formed inside the ring 28 for engaging the teeth 33 when the cap is first unscrewed.

The teeth 33 and the opposing teeth 34 are intercalated with a predetermined pitch conforming to the predetermined pitch of the coupling of the splines 24 and 25 of the splined coupling 26 upon fitting.

The teeth 33 and the opposing teeth 34 have sawtooth-like profiles with faces indicated 33*a* and 34*a*, respectively. The faces 33*a* of the teeth 33 are inclined rearwardly at an angle A, whereas the faces 34*a* of the opposing teeth 34 are inclined forwardly at an angle B, with reference to the sense in which the cap is unscrewed.

The angles of inclination A and B have a predetermined value selected between 5° and 25° and in the embodiment shown are 15°.

The closure 1 according to the invention is assembled with all its parts as a unit which can be handled individually and is intended to be fitted on a bottle as such.

When the cap 4 is first unscrewed, first of all the weakened line 27 between the inner cap and the cylindrical sleeve tears; the unscrewing then starts and continues until the opposing teeth 34 engage the teeth 33, face to face. The ring 28 is thus restrained against any further rotation by the cylindrical sleeve. If the unscrewing action is continued, the weakened line 29 tears. At this point, the ring 28 is separated from the outer cap 19 and breaks up into the two portions 30 and 31 into which it is divided. The portions fall due to their own weight, sliding on the sloping shoulder 3*a*.

They leave their initial positions for ever and, owing to gravity, can no longer be replaced or remain there.

The inclinations of the faces of the teeth and of the opposing teeth prevent both a situation in which the two portions 30 and 31 into which the ring is divided are urged radially outwardly without tearing of the weakened line and with the teeth being overlapped by the opposing teeth, and a situation in which the two portions 30 and 31 are drawn radially inwardly with tearing of the weakened line but with the teeth firmly engaging the opposing teeth.

The predetermined inclinations of the faces of the teeth and of the opposing teeth simultaneously ensure both the tearing of the weakened line and the separation of the two portions into which the ring is divided.

The main advantage of the closure according to the present invention lies in the particularly unmistakeable manner in which any unauthorized opening becomes apparent, by virtue of the fact that it is impossible to reassemble the security ring.

A further advantage of the closure according to the invention lies in its structural simplicity which is one of the most important advantages for an article which has to be produced on a very large scale.

Naturally an expert in the art may apply many modifications and variations to the closure according to the invention in order to satisfy contingent and specific requirements, all within the scope of protection of the invention as defined by the following claims.

I claim:

1. A security closure for bottles and other containers, comprising a pourer body, a cylindrical sleeve having an internal rim for retaining the pourer body, a cap, a threaded coupling between the cap and the pourer body for the unscrewing and screwing of the cap, and a security band comprising a ring which is fixed to the cap by means of a weakened line, external teeth being formed on the cylindrical sleeve and opposing internal teeth being formed on the ring for engaging the external teeth when the cap is first unscrewed, wherein the ring is divided into at least two portions and the external teeth are formed in a recess in the cylindrical sleeve defined by a sloping shoulder.

2. A closure according to claim 1, wherein the teeth and the opposing teeth have sawtooth-like profiles with respective faces, the faces of the teeth being inclined rearwardly and the faces of the opposing teeth being inclined forwardly, with reference to the sense in which the cap is unscrewed.

3. A closure according to claim 2, wherein the faces of the teeth and of the opposing teeth are inclined at respective predetermined angles, selected between 5° and 25°.

4. A closure according to claim 1, wherein the cap comprises an inner cap and an outer cap, which is fitted onto the inner cap, the ring being fixed to the outer cap by means of the weakened line.

5. A closure according to claim 4, wherein the inner cap is fixed to the cylindrical sleeve by means of a weakened line.

6. A closure according to claim 5, wherein it comprises connection means between the outer cap and the inner cap for fixing them together.

7. A closure according to claim 6 wherein the connection means comprise collars on the inner cap and annular projections in the outer cap which are snap-engaged one above another to form a coupling in order to fix the outer cap and the inner cap together axially.

8. A closure according to claim 7, wherein the connection means comprise a splined coupling for fixing the outer cap and the inner cap together with regard to rotation.

9. A closure according to claim 8, wherein the splined coupling comprises axial splines and with pointed lead-in tips for guiding the outer cap onto the inner cap in accordance with a predetermined angular pitch, upon fitting.

* * * * *

UNITED STATES PATENT AND TRADEMARK OFFICE

CERTIFICATE OF CORRECTION

PATENT NO. : 5,740,932

DATED : April 21, 1998

INVENTOR(S) : Piero BATTEGAZZORE

It is certified that error appears in the above-identified patent and that said Letters Patent is hereby corrected as shown below:

On the title page: Item [30] Foreign Patent: add

--Claim of Priority - European Patent Application No. 94830531.3, Filed November 9, 1994--.

Signed and Sealed this

Tenth Day of November 1998

*Attest:*

*Attesting Officer*

BRUCE LEHMAN

*Commissioner of Patents and Trademarks*